United States Patent [19]

Vicens

[11] 4,319,518

[45] Mar. 16, 1982

[54] WELL SWAB CUPS

[76] Inventor: Miguel F. Vicens, 615 Mexico St., Buenos Aires, Argentina

[21] Appl. No.: 85,383

[22] Filed: Oct. 16, 1979

[51] Int. Cl.[3] ..... F16J 9/00

[52] U.S. Cl. ..... 92/241; 92/254; 417/555 A

[58] Field of Search ..... 417/555 A; 92/241, 254

[56] References Cited

U.S. PATENT DOCUMENTS

| | | | |
|---|---|---|---|
| 1,541,166 | 6/1925 | Mowers | 92/241 X |
| 2,466,572 | 4/1949 | Bowerman et al. | 417/555 A |
| 3,346,267 | 10/1967 | Farley | 92/241 |
| 4,190,108 | 2/1980 | Webber | 92/254 X |

*Primary Examiner*—Carlton R. Croyle
*Assistant Examiner*—Edward Look
*Attorney, Agent, or Firm*—LeBlanc, Nolan, Shur & Nies

[57] ABSTRACT

A swab cup for oil wells is provided which comprises means by which the elastic side walls of the cups can be radially expanded almost throughout their entire length. The oil well swab cup has a substantially cylindrical uniform wall thickness resilient annular body having a multiplicity of parallel metallic longitudinal wires imbedded in its external periphery, the lower end of each wire terminating in a hook-like formation extending into relatively free articulation with a retainer wire ring imbedded in the lower end of the body.

6 Claims, 4 Drawing Figures

WELL SWAB CUPS

This invention refers to improvements in swab cups for oil wells. More specifically it relates to a swab cup that includes a resilient cup body, the side walls of which are reinforced by reinforcing wires that extend lengthwise just within the external surface layer of the wall and are relatively freely articulated at their lower ends with respect to a retainer ring imbedded in the body.

The swab cups of this type have a central opening at the bottom through which a conventional swab mandrel passes and provides a ring or flange below the lower portion of the swab cup as a seat, to which is fitted the lower end of the cup as by a plastic annular part, thus providing a liquid-tight joint in the upward stroke of the cup wherein the mandrel pulls the cup upwardly lifting it by means of the ring or flange. This known construction is shown, for example, in U.S. Pat. No. 4,190,108.

The improvements in the swab cup herein asserted comprise means by which the elastic side walls of the cup can be radially expanded almost throughout their entire length, such expansion being substantially uniform from the upper end to at least near the lower end which sits on the ring or flange of the mandrel, and this is the major object of the invention.

It is another object of the invention to provide a novel oil well swab cup or the like having a substantially cylindrical uniform wall thickness resilient annular body having a multiplicity of parallel metallic longitudinal wires imbedded in its external periphery, the lower end of each wire being imbedded within the body at its lower end and terminating in a hook-like formation extending into relatively free articulation with a retainer wire ring imbedded in the lower end of the body.

PREFERRED EMBODIMENTS

Figures 1, 2, 3, 4:
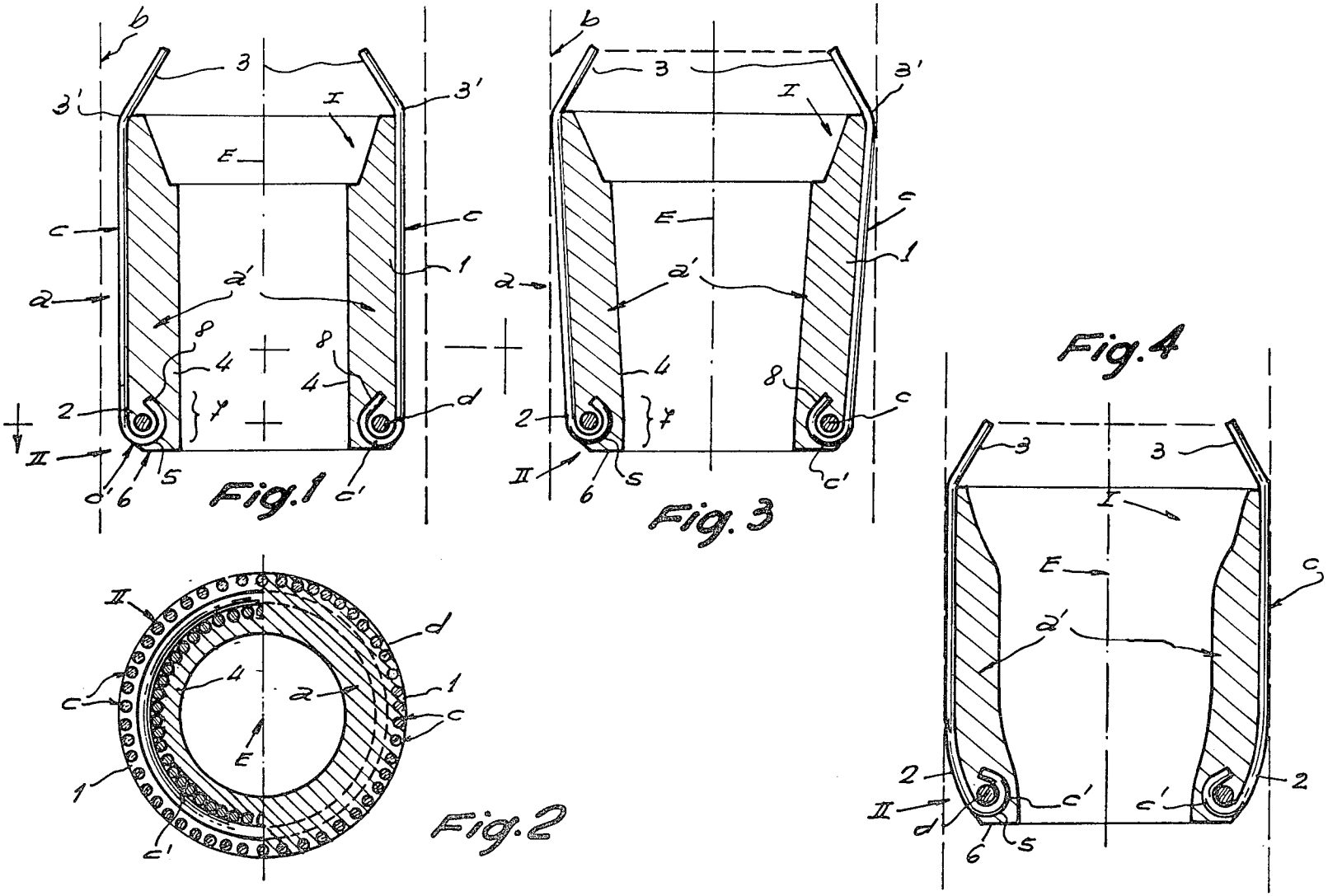
FIG. 1 is a longitudinal section showing a well swab cup according to a preferred embodiment, in relaxed condition with its periphery spaced from the oil well tube wall.
FIG. 2 is a transverse section across the cup of FIG. 1 showing location of the longitudinal wires substantially at the external surface of the body.
FIGS. 3 and 4 are sections similar to FIG. 1 and show stages in expansion of the swab cup as it expands under pressure to engage the wall of the oil well tube.

In the invention the casing assembly a, which may be cup-type coil well swab is vertically movable within a fixed vertical axis cylindrical tube b which may be the ascent tube of an oil well. Both tube b and casing body a′ are symmetrical about a common axis E which is the axis of reciprocation of casing body a′. The mechanism for mounting and moving the cup are not shown.

The annular casing body a′ is tubular as shown and of substantially uniform wall thickness and cross section between its upper mouth indicated at I and its foot indicated at II. Casing body a′ is integral and of elastomeric material such as rubber whereby it may be radially expanded by the internal pressure of liquid. Casing body a′ is thus an essentially uniform thickness tube having a central cylindrical bore 4 and a cylindrical outer surface.

A plurality of parallel side by side wires c are imbedded in the material of casing body a′ as shown substantially over and very near its entire external cylindrical surface. Wires c are very closely and uniformly spaced from each other as shown circumferentially of the outer surface of casing body a′ all around that surface. Wires c lie in radial planes of body a′.

Imbedded within the lower end 7 of casing body a′ at the foot end is a metallic wire ring d which may be a continuous ring or a split ring capable of some circumferential expansion relative to the body. Ring d lies in a plane perpendicular to axis E.

At their lower ends 2 each wire is formed arcuately with an upwardly open hook c′ that extends radially inwardly of the casing body more than 180° so as to extend in spaced relation more than 180° around wire d and terminate in an end 8 that is disposed in the material vertically above wire d. The hooks c′ lie in spaced radial planes around the casing body a′, and each of the hooks c′ is capable of displacement at least radially outwardly with respect to wire d, such displacement being controlled and determined by compression of the material between the interior of the hook and wire d. The lower convex edge 5 of each hook is disposed near the flat lower end surface 6 of the body.

At their upper ends each wire c bends in a curve 3′ radially inwardly with respect to the mouth end of casing a′ to provide converging equally inclined free upper ends 3 of the same length that terminate above the mouth I.

When there is no internal pressure in the casing a as when it is descending tube b there is radial clearance between the outer wire reinforced body surface and the tube b.

In operation as the casing a ascends within its tube b, which for example may be an oil well tubing as in the above mentioned Webber patent, the internal pressure exerted by the oil being lifted within the swab cup tends to radially expand the casing body.

This pressure is initially and strongly effective at the upper or mouth end I tending to radially outwardly expand the upper end of body a′ into contact with the tube inner wall as shown in FIG. 3, and as the pressure increases the major portion of the length of body a′ is radially outwardly expanded until the major portion of its wire reinforced outer surface contacts slidably the wall of tube b. As the body expands the relatively loose articulated connection between the retainer ring and the hooked lower ends of the wires permits the body lower end to expand radially outwardly relative to retainer wire d while the latter is effective to keep the lower ends of the wires imbedded within the body a′. Thus as shown in FIG. 4, the expanded body a′ presents along its outer surface major straight wire reinforced sections parallel to axis E, with sometimes the minor lower ends 2 of the wires flexed away from the tube wall (shown exaggeratively).

Thus in the invention the swab cup adapts itself along substantially its entire length into conformity with the inner surface of the well tube, which is a great improvement over prior cups which adapt to the well tube mainly only around their upper ends. In the invention there is less wear at the upper end as compared to earlier cups where the concentrated forces at the upper end may damage the cup body. The sliding contact is distributed over a larger area and wear is uniform.

Expansion of the body a′ pushes the wires outward to more tightly compress the very thin outer layer of rubber which after repeated sliding may wear away so that the exposed wires form an effective skid shoe reducing wear on the casing a.

Where the ring d is a continuous ring the permitted outward displacement of the hooked ends of the wires and in combination some measure the flexibility of the wires permits full radial expansion of body a' substantially along its entire length.

The invention also includes the feature of rendering ring d circumferentially expansible either resiliently or by a split one-piece ring with opposite ends overlapped. Alternatively two one-piece split rings d may be used, one just above the other imbedded in the body with their split sections circumferentially displaced.

This arrangement wherein the ring is circumferentially expansible permits even more of the body external wall to conform to the inner surface of the well tube.

What is claimed is:

1. An improved swab cup for tubing of oil wells which comprises a tubular body of resilient material with a plurality of parallel reinforcing flexible metallic wires extending lengthwise and equally spaced around the tubular body, each wire having a long intermediate portion embedded into the external surface of said body and a lower end portion embedded in the lower part of the body and curved inwardly, upwardly and then towards the inner surface of an intermediate portion of said body, a retainer ring embedded in the lower part of said body, each lower wire end portion forming a hook which relatively loosely connects upwardly with said retaining ring which has common connection to all said reinforcing wires, there being an annular portion of the resilient material of the body interposed at least between the inner peripheral surface of said ring and the inner portions of said hooks and each hook providing articulated engagement with the ring within the lower annular portion of the body for allowing the reinforcing wires to be displaced toward the surrounding tubing according the expansion of the tubular cup body, whereby said wires become adapted to the surface contour of said tubing practically along the whole length of said body.

2. Improvements to a swab cup as per claim 1, wherein the ring is elastically expansible, formed by a ring cut obliquely in such a manner that the two ends overlap.

3. Improvements to a swab cup as per claim 1, wherein the ring is an elastically expansible composite and comprises two identical cut rings concentrically superposed, with the cut of one diametrically opposite that of the other, so that the uncut part of each closes the adjacent cut of the other when the cut ends separate as a result of circumferential expansion of the two rings.

4. An improved oil well tubing swab cup comprising an annular body of resilient material having substantially uniform wall thickness from end to end, a multiplicity of substantially parallel wires extending longitudinally of said body, said wires being closely equally spaced circumferentially of said body and lying in radial planes of said body, each wire having an intermediate long substantially straight portion imbedded just within the external surface of said body for a major part of the length of said body and an upwardly open hook formation on its lower end imbedded within the lower portion of said body, a metallic ring imbedded in the lower portion of said body and lying in a transverse plane, said hook formations extending around said ring but being of larger diameter whereby resilient material of said body is interposed between each hook and the ring to provide an articulated joint therebetween.

5. The swab cup defined in claim 4, wherein said ring is resilient and circumferentially expansible.

6. The swab cup defined in claim 5, wherein said ring is a split ring having overlapping opposite ends.

* * * * *